US005258730A

United States Patent [19]

Stern et al.

[11] Patent Number: 5,258,730

[45] Date of Patent: Nov. 2, 1993

[54] MICROSTRIP TRANSMISSION LINE SUBSTRATE TO SUBSTRATE TRANSITION

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 973,361

[22] Filed: Nov. 9, 1992

[51] Int. Cl.[5] ..... H01P 3/08

[52] U.S. Cl. ..... 333/246; 333/26

[58] Field of Search ..... 333/246, 204, 26, 34, 333/260

[56] References Cited

U.S. PATENT DOCUMENTS 4,745,377 5/1988 Stern et al. ..... 333/26

*Primary Examiner*—Robert J. Pascal
*Assistant Examiner*—Darius Gambino
*Attorney, Agent, or Firm*—Michael Zelenka; William H. Anderson

[57] ABSTRACT

A microstrip transmission line substrate to substrate transition is provided comprising a pair of spaced-apart dielectric substrates having facing inner surfaces and ground planes on the non-facing outer surfaces and a parallelepiped-shaped dielectric waveguide element sandwiched between the substrate inner surfaces. The waveguide element has a pair of rhomboidal-shaped sides and a pair of sloping ends. A first microstrip conductor is disposed on the inner surface of one of the substrates and the upwardly-sloping end of the waveguide element contiguous to that surface. A second microstrip conductor is disposed on the inner surface of the other substrate and the other sloping end of the waveguide element, so that a pair of mutually-inverted microstrip transmission lines is formed. The dielectric constant of the material of the substrates is preferably much less than the dielectric constant of the waveguide element material.

7 Claims, 1 Drawing Sheet

MICROSTRIP TRANSMISSION LINE SUBSTRATE TO SUBSTRATE TRANSITION

GOVERNMENT INTEREST

The invention described herein may be manufactured, used, and licensed by or for the Government for governmental purposes without the payment to us of any royalties thereon.

BACKGROUND OF THE INVENTION

I. Field of the Invention

This invention relates to microstrip transmission lines operating in the millimeter wave region of the frequency spectrum and, more particularly, to a transition for providing a low loss, broadband interconnection between a microstrip transmission line dielectric substrate and another microstrip transmission line dielectric substrate.

II. Description of The Prior Art

Microstrip transmission line circuitry is widely used in radar and communications systems and subsystems operating in the millimeter wave region of the frequency spectrum. The use of such planar circuitry in systems and equipment permits the system and low weight. A problem frequently encountered, however, is the connection of one microstrip transmission line substrate to another microstrip transmission line substrate. The connection circuitry or "transition" must not only be of compact design and small size and low weight but must permit the electrical connection to be made without violating the boundary line conditions, e.g., electric field orientation, etc., which are necessary for successful wave propagation at the millimeter wave frequencies. Many of the prior art solutions of the transition problem require that the microstrip transmission dielectric substrate be perforated with a hole or other opening to accommodate the transition element. This adds to the labor costs of fabricating the transition equipment and often requires the use of skilled assembly labor thereby raising the overall costs of the system or equipment in which the transition is used.

SUMMARY OF THE INVENTION

It is an object of this invention to provide a microstrip transmission line substrate to substrate transition of relatively simple construction which readily lends itself to the fabrication of compact and light weight millimeter wave equipment.

It is a further object of this invention to provide a microstrip transmission line substrate to substrate transition which does not require the use of holes or other apertures in the substrates to be connected.

It is a still further object of this invention to provide a microstrip transmission line substrate to substrate transition which permits simplified and economical assembly techniques to be utilized during fabrication of the transition.

It is another object of this invention to provide a microstrip transmission line substrate to substrate transition which provides a low insertion loss and a broadband interconnection between the substrates to be connected.

Briefly, the microstrip transmission line substrate to substrate transition of the invention comprises a pair of microstrip transmission line dielectric substrates each having a first surface on one side thereof and a second surface on the other side thereof. The pair of substrates are spaced apart so that their first surfaces face each other. Electrically conductive ground plane means are mounted on the second surface of each substrate of the pair of substrates. A dielectric waveguide element shaped as a six-faced prism is disposed between the pair of spaced apart substrates. The waveguide element has a first pair of oppositely-disposed prism faces abutting the first surfaces of the pair of substrates and second and third pairs of oppositely-disposed prism faces each extending between the first surfaces of the pair of substrates. One prism face of the third pair of prism faces is sloped at an acute angle with respect to the first surface of one substrate of the pair of substrates and the other prism face of the third pair of prism faces is sloped at an obtuse angle with respect to the first surface of the one substrate of the pair of substrates. First electrically conductive microstrip conductor means are disposed on the first surface of the one substrate of the pair of substrates and the one prism face of the third pair of prism faces of the waveguide element. Finally, second electrically conductive microstrip conductor means are disposed on the first surface of the other substrate of the pair of substrates and the other prism face of the third pair of prism faces of the waveguide element.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
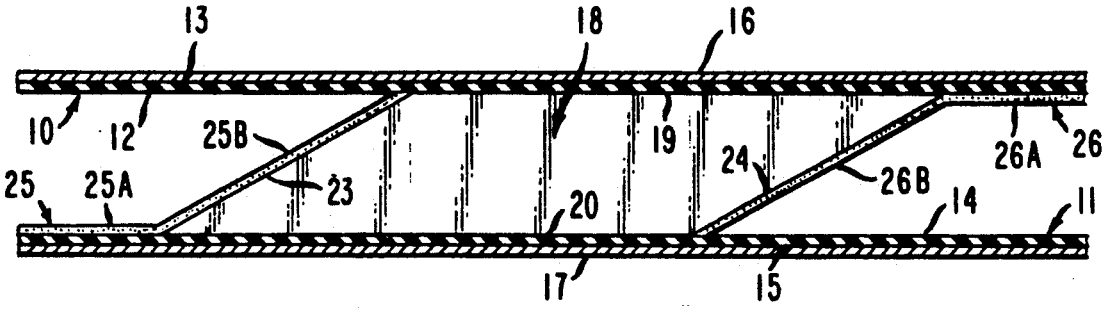
FIG. 1 is a side elevational view, partly in section, of the microstrip transmission line substrate to substrate transition of the invention.
Figure 2:
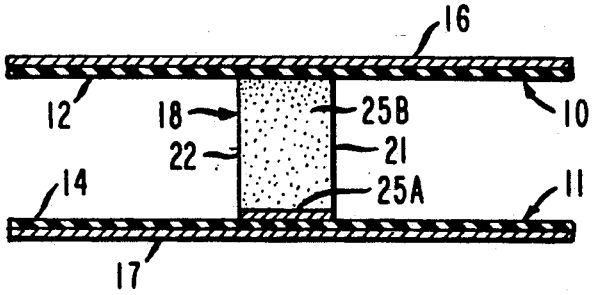
FIG. 2 is an end elevational view of the transition of the invention taken from the left in the view of FIG. 1.
Figure 3:
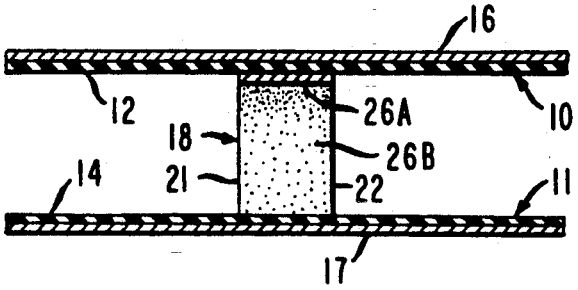
FIG. 3 is an end elevational view of the transition of the invention taken from the right in the view of FIG. 1.

Referring now to FIGS. 1, 2 and 3 of the drawings, there is shown a microstrip transmission line substrate to substrate transition constructed in accordance with the teachings of the present invention comprising a pair of microstrip transmission line dielectric substrates, indicated generally as 10, and 11. Each of the substrates 10 and 11 has a first planar surface on one side thereof and a second planar surface on the other side thereof. Thus, substrate 10 has a first surface 12 and a second surface 13 while substrate 11 has a first surface 14 and a second surface 15. The pair of substrates are spaced apart so that their first surfaces 12 and 14 face each other. Each of the substrates 10 and 11 may comprise a section of conventional microstrip transmission line substrate which is usually fabricated of Duroid or other similar dielectric material having a relatively low dielectric constant ranging from about 2.2 to 16. The aforementioned Duroid would have a dielectric constant of 2.2 and the thickness of the Duroid would usually be about 0.010 inches.

An electrically conductive ground plane 16 is disposed on the second surface 13 of the substrate 10 and another electrically conductive ground plane 17 is disposed on the second surface 15 of the substrate 11. Each of the ground planes 16 and 17 should be fabricated of a good conducting metal, such as copper or silver, for example.

A dielectric waveguide element, indicated generally as 18, is disposed between the pair of spaced apart substrates 10 and 11. The waveguide element 18 is shaped as a six-faced prism and has a first pair of oppositely-disposed prism faces 19 and 20 which abut the first surfaces 12 and 14, respectively, of the pair of substrates 10 and 11. The waveguide element 18 has a second pair of oppositely-disposed prism faces 21 and 22 and a third pair of oppositely-disposed prism faces 23 and 24. The prism faces of each of the second and third pairs of prism faces all extend between the first surfaces 12 and 14 of the pair of substrates as may be seen in FIGS. 1 and 2 of the drawings. One prism face 23 of the third pair of prism faces is sloped at an acute angle with respect to the first surface 14 of the substrate 11 while the other prism face 24 of the third pair of prism faces is sloped at an obtuse angle with respect to the first surface 14 of the substrate 11. It may also be said that prism face 24 is sloped at an acute angle with respect to the first surface 12 of the substrate 10 and that the prism face 23 is correspondingly sloped at an obtuse angle with respect to the first surface 12 of the same substrate 10. The dielectric waveguide element 18 is fabricated of a material having a low loss in the frequency region of interest and may have a dielectric constant ranging from about 4 to 16. The dielectric material employed in the waveguide element 18 may, for example, be magnesium titanate which has a dielectric constant of 13.

First electrically conductive microstrip conductor means, indicated generally as 25, has a portion 25A disposed on the first surface 14 of the substrate 11 and portion 25B disposed on the prism face 23 of the third pair of prism faces of the dielectric waveguide element 18 as seen in FIGS. 1 and 2 of the drawings. It will be noted that prism face 23 is the prism face of the third pair of prism faces of the waveguide element which slopes at an acute angle with respect to the first surface 14 of the substrate 11. Second electrically conductive microstrip conductor means, indicated generally as 26, has a portion 26A disposed on the first surface 12 of the other substrate 10 of the pair of substrates and a portion 26B disposed on the other prism face 24 of the third pair of prism faces of the waveguide element 18 as may be seen in FIGS. 1 and 3 of the drawings. It will be noted that prism face 24 of the third pair of prism faces of the waveguide element 18 is the prism face which slopes at an obtuse angle with respect to the first surface 14 of the substrate 11. Both the first and second microstrip conductor means should be fabricated of a good electrically conductive material such as copper or silver, for example.

By virtue of the foregoing arrangement, it will be seen that the portion 25A of the microstrip conductor means 25 which is disposed on the first surface 14 of the substrate 11, the substrate 11 itself and the ground plane 17 combine to form a first microstrip transmission line while the portion 26A of the microstrip conductor means 26 which is disposed on the first surface 12 of the substrate 10, the substrate 10 itself and the ground plane 16 combine to form a second microstrip transmission line, albeit in an inverted position with respect to the first transmission line. The portion 25B of the microstrip conductor 25 which is disposed on the sloping prism face 23 of the third pair of prism faces of the dielectric waveguide element 18 cooperates with the dielectric waveguide element 18, the dielectric substrate 11 and the ground plane 17 to gradually convert a signal being transmitted in the microstrip transmission line mode of propagation along the microstrip transmission line formed by substrate 11 to the solid dielectric waveguide mode of propagation through the dielectric waveguide element 18. The mechanism by which this is accomplished is explained more in detail in U.S. Pat. No. 4,745,377, Issued May 17, 1988 to the same inventors as the present application and assigned to the same assignee as the present application, and will not be described further herein. As explained in the said U.S. Pat. No. 4,745,377, this change in mode of signal propagation is accomplished with only a minimal change in impedance of the overall transmission line, thereby eliminating the need for transformers and other impedance matching techniques At the point where the sloping prism face 23 intersects the first surface 12 of substrate 10, the signal being transmitted will be virtually completely captured by the waveguide element 18 which will then transmit the signal in the solid waveguide mode of transmission until it reaches the sloping prism face 24 of the waveguide element. At that point, the portion 26B of the microstrip conductor means 26 which is disposed on the other prism face 24 of the third pair of prism faces cooperates with the dielectric waveguide element 18, the dielectric substrate 10 and the ground plane 16 to gradually convert the signal being transmitted through the dielectric waveguide element in the dielectric waveguide mode of propagation back into the microstrip transmission line mode of propagation. When the signal reaches the portion 26A of the microstrip conductor means 26 which is disposed on the first surface 12 of the substrate 10 it will again be in the microstrip mode of transmission. Accordingly, the microstrip transmission line formed by the substrate 11 is, by virtue of the transition of the invention, effectively connected to the microstrip transmission line formed by the substrate 10.

When the first surfaces 12 and 14 of the pair of substrates 10 and 11 are parallel to each other, the dielectric waveguide element 18 may be shaped as a parallelepiped, which is essentially a prism with six faces, each face being a parallelogram. The prism faces 21 and 22 of the second pair of prism faces of the dielectric waveguide element 18 may be shaped as rhomboids, so that the prism faces of the first pair of prism faces and the third pair of prism faces of the waveguide element 18 are rectangular in shape. Although the transition of the invention will operate when the dielectric constant of the substrate material of the two substrates being connected is approximately the same as the dielectric constant of the material of the dielectric waveguide element 18, albeit with an increase in line impedance, the dielectric constant of the microstrip substrate material should preferably be much less than the dielectric constant of the dielectric waveguide element material.

It is apparent that the substrate to substrate transition of the invention does not require either of the substrates to be joined to be punched or drilled or to be provided with other apertures. The assembly of the unit is simple, requiring only the insertion of the parallelepiped-shaped dielectric waveguide element 18 between the microstrip transmission lines to be joined. To this end, it may be noted that the microstrip conductor means 25 may comprise either a single length of microstrip conductor, i.e., portions 25A and 25B would together comprise a single unitary length, or the portions 25A and 25B may each comprise a separate, single length of microstrip conductor, which single, separate lengths are electrically interconnected. Similarly, the microstrip conductor means 26 may comprise either a single unitary length of conductor or two, electrically-interconnected separate lengths.

The disposition of one microstrip transmission line circuit above the other in an inverted position provides an inherent shielding effect which reduces circuit losses and also results in minimizing overall subsystem size. Based upon the experience of the inventors with respect to the transition shown in said U.S. Pat. No. 4,745,377, it is expected that the loss of the present transition will be less than 1dB. Finally, it will be noted that the connection of the two microstrip transmission line substrates t be connected has been accomplished without violating any of the boundary conditions necessary for proper wave propagation at these frequencies. The electric field in the microstrip lines conforms to that of the transition section, i.e., being vertical and spanning between the ground planes and the top strip conductors, with the E-field pattern being symmetrical and/or reversible.

It is believed apparent that many changes could be made in the construction and described uses of the foregoing microstrip transmission line substrate to substrate transition and many seemingly different embodiments of the invention could b constructed without departing from the scope thereof. Accordingly, it is intended that all matter contained in the above description or shown in the accompanying drawings shall be interpreted as illustrative and not in a limiting sense.

What is claimed is:

1. A microstrip transmission line substrate to substrate transition comprising:

a pair of microstrip transmission line dielectric substrates, each of said substrates having a first surface on one side thereof and a second surface on the other side thereof, said pair of substrates being spaced apart so that their first surfaces face each other;

electrically conductive ground plane means mounted on said second surface of each substrate of said pair of substrates;

a dielectric waveguide element shaped as a six-faced prism disposed between said pair of spaced apart substrates, said waveguide element having a first pair of oppositely-disposed prism faces abutting said first surfaces of said pair of substrates and second and third pairs of oppositely-disposed prism faces each extending between said first surfaces of said pair of substrates, one prism face of said third pair of prism faces being sloped at an acute angle with respect to the first surface of one substrate of said pair of substrates and the other prism face of said third pair of prism faces being sloped at an obtuse angle with respect to said first surface of said one substrate of said pair of substrates;

first electrically conductive microstrip conductor means disposed on said first surface of said one substrate of said pair of substrates and said one prism face of said third pair of prism faces of said waveguide element; and second electrically conductive microstrip conductor means disposed on said first surface of the other substrate of said pair of substrates and said other prism face of said third pair of prism faces of said waveguide element.

2. A microstrip transmission line substrate to substrate transition as claimed in claim 1 wherein said first surfaces of said pair of substrates are substantially parallel to each other, and said dielectric waveguide element is substantially shaped as a parallelepiped.

3. A microstrip transmission line substrate to substrate transition as claimed in claim 2 wherein the prism faces of said first pair of prism faces and said third pair of prism faces of said dielectric waveguide element are substantially rectangular in shape, and the prism faces of said second pair of prism faces of said dielectric waveguide element are substantially rhomboidal in shape.

4. A microstrip transmission line substrate to substrate transition as claimed in claim 3 wherein the dielectric constant of said pair of microstrip transmission line dielectric substrates is no greater than the dielectric constant of said dielectric waveguide element.

5. A microstrip transmission line substrate to substrate transition as claimed in claim 3 wherein the dielectric constant of said pair of microstrip transmission line dielectric substrates is much less than the dielectric constant of said dielectric waveguide element.

6. A microstrip transmission line substrate to substrate transition as claimed in claim 3 wherein each of said first and second electrically conductive microstrip conductor means comprises a single length of microstrip conductor.

7. A microstrip transmission line substrate to substrate transition as claimed in claim 3 wherein each of said first and second electrically conductive microstrip conductor means comprises a first length of microstrip conductor disposed on the first surface of the substrate associated therewith and a second length of microstrip conductor disposed on the prism face of said third pair of prism faces of said waveguide element associated therewith, said second length of conductor being electrically connected to said first length of conductor.

* * * * *